United States Patent [19]

Wagoner

[11] Patent Number: 4,571,743

[45] Date of Patent: Feb. 25, 1986

[54] COVERLET FOR NON-AMBULATORY PATIENTS

[76] Inventor: Dorothy M. Wagoner, 1620 Rover Rd., Modesto, Calif. 95351

[21] Appl. No.: 742,772

[22] Filed: Jun. 10, 1985

[51] Int. Cl.[4] ..... A41D 3/08

[52] U.S. Cl. ..... 2/88; 2/114

[58] Field of Search ..... 2/88, 69, 114, DIG. 7, 2/90

[56] References Cited

U.S. PATENT DOCUMENTS

| | | | |
|---|---|---|---|
| D. 184,085 | 12/1958 | Davidow | D3/26 |
| D. 227,518 | 7/1973 | Collet | D2/2 |
| D. 267,206 | 12/1982 | Slabbinck | D2/2 |
| 2,808,591 | 10/1957 | Grant | 2/88 |
| 3,031,676 | 5/1962 | Larson | 2/50 |
| 3,078,467 | 2/1963 | Artzt | 2/114 |
| 3,742,519 | 7/1973 | Wiley | 2/88 |

*Primary Examiner*—Doris L. Troutman

*Attorney, Agent, or Firm*—Craig A. Wood

[57] ABSTRACT

A coverlet is disclosed for wear by non-ambulatory patients during transportation in shower chairs and mobile commodes. Counterpart front panels are attached together, and counterpart back panels are attached to the front panels so as to provide head and arm openings and entry from the back. Dimensions of the front and back panels are chosen to accommodate patients of varying physiques and to prevent interference with moving parts of shower chairs and mobile commodes.

10 Claims, 4 Drawing Figures

COVERLET FOR NON-AMBULATORY PATIENTS

BACKGROUND OF THE INVENTION

1. Field of the Invention

The present invention relates to coverlets and in particular to coverlets which are suitable to cover non-ambulatory patients during transportation in shower chairs and mobile commodes.

2. Description of Prior Art

Non-ambulatory patients in health care facilities, nursing homes, convalescent hospitals and other places must frequently be moved about such facilities for bodily cleansing and hygiene purposes. Presently, patients are commonly transported in shower chairs and mobile commodes while wrapped in ordinary blankets, however, blankets are often rearranged by patients or accidentally slip, thereby exposing portions of patients in an undignified and embarrassing manner. Concern for the rights of patients in health care and convalescent facilities is mandated both by the Federal requirements for certification as a provider of such services, and by requirements of the states.

Coverlets per se are not new, and commonly fasten in the back by tie arrangements. Various articles exist that can be used to cover non-ambulatory patients during transportation, including the articles of U.S. Pat. No. Des. 184,085, U.S. Pat. Nos. 3,031,676, Des. 227,518, 3,742,519 and Des. 267,206. Despite the availability of such articles, there exists a need in the art for a coverlet that will prevent the undignified exposure of patients during transportation, yet is easily and quickly placed about patients and does not interfere with the moving portions of shower chairs and mobile commodes.

SUMMARY OF THE INVENTION

In order to aid in the understanding of the present invention, it can be stated in essentially summary form that it is directed to a coverlet for non-ambulatory patients that is capable of easily and completely covering patients, except for the head, lower forearms and hands, and lower calves and feet, during the transportation of patients in shower chairs and mobile commodes in and about health care facilities. The coverlet is formed from two mirror-image front panels and two mirror-image back panels, each panel having an armhole notch and a neckhole notch. The shapes of the panels are chosen so that the coverlet does not interefere with the movement of shower chairs and mobile commodes. Quick release fasteners are provided at the back of the coverlet to facilitate easy entry and exit of patients of varying physiques.

It is an object of the present invention to provide a coverlet for non-ambulatory patients that is capable of covering patients during transportation in a shower chair or a mobile commode.

It is another object of the present invention to provide a coverlet for non-ambulatory patients that does not interefere with the operation or movement of a shower chair or mobile commode during transportation of patients.

It is still another object of the present invention to provide a coverlet for non-ambulatory patients that can be easily and quickly placed about and removed from patients.

It is yet another object of the present invention to provide a coverlet for non-ambulatory patients that can be used for patients of various physiques and of both sexes.

Further objects and advantages of this invention will be apparent from a study of the followig portion of the specification, the claims and the attached drawings.

DESCRIPTION OF THE PREFERRED EMBODIMENT

The following specification, taken in conjunction with the drawings, sets forth the preferred embodiment of the present invention. The embodiment of the invention disclosed herein is the best mode contemplated by the inventor for carrying out her invention in a commercial environment, although it should be understood that various modifications can be accomplished within the parameters of the present invention.

Figure 1:
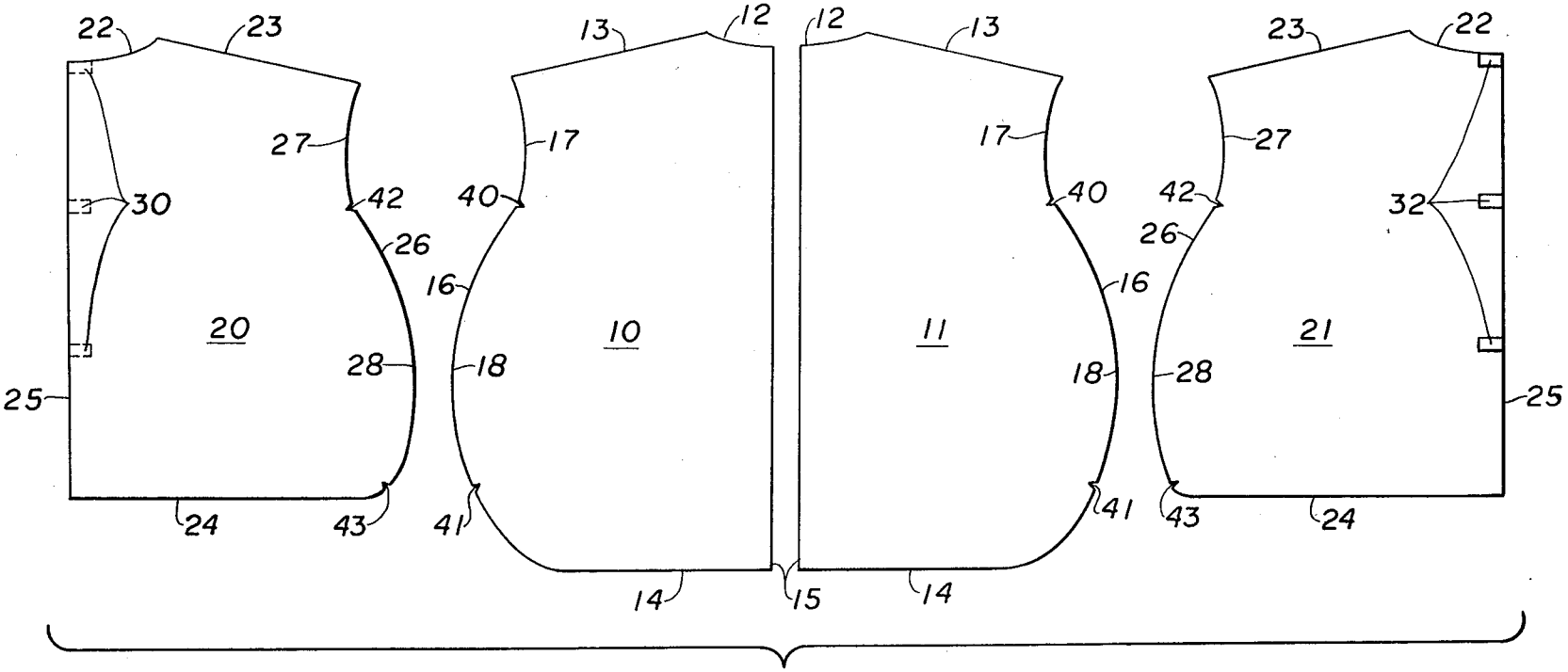
FIG. 1 is a view of the separated right and left front and back panels of a coverlet for non-ambulatory patients embodying the present invention.

Referring now to the drawings for a detailed description of the present invention, reference is first made to FIG. 1, showing mirror-image right and left front panels 10 and 11, respectively, each having a curved front neck notch 12 of approximately six inches in length, a sloping front shoulder edge 13 of approximately twenty-two inches in length, a front bottom edge 14 of approximately twenty inches in length, a seam edge 15 of approximately forty-four inches in length, and a curvilinear front edge 16 having arched upper front portion 17 of approximately ten inches in length, and arched lower front portion 18 of approximately thirty-three inches in length.

FIG. 1 also depicts right back panel 20 and left back panel 21, each having a curved back neck notch 22 of approximately eight inches in length, a sloping back shoulder edge 23 of approximately twenty-two inches in length, a back bottom edge 24 of approximately twenty-six inches in length, a opening edge 25 of approximately thirty-six inches in length and curvilinear back edge 26 having arched upper back portion 27 of approximately ten inches in length, and arched lower back portion 28 of approximately twenty-five inches in length. Additionally, as depicted in FIG. 3, a plurality of hook side VELCRO strips 30 are attached to exterior surface 31 of right back panel 20 along opening edge 25, and a plurality of corresponding eye side VELCRO strips 32 are attached to interior surface 33 of left back panel 21, along opening edge 25.

Figure 2:
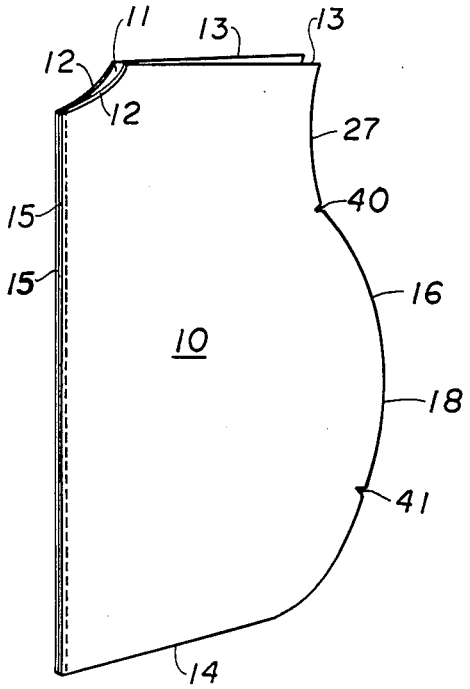
FIG. 2 illustrates the assembly of right and left front panels of a coverlet for non-ambulatory patients embodying the present invention, with the right panel appearing in the forefront.
Figure 3:
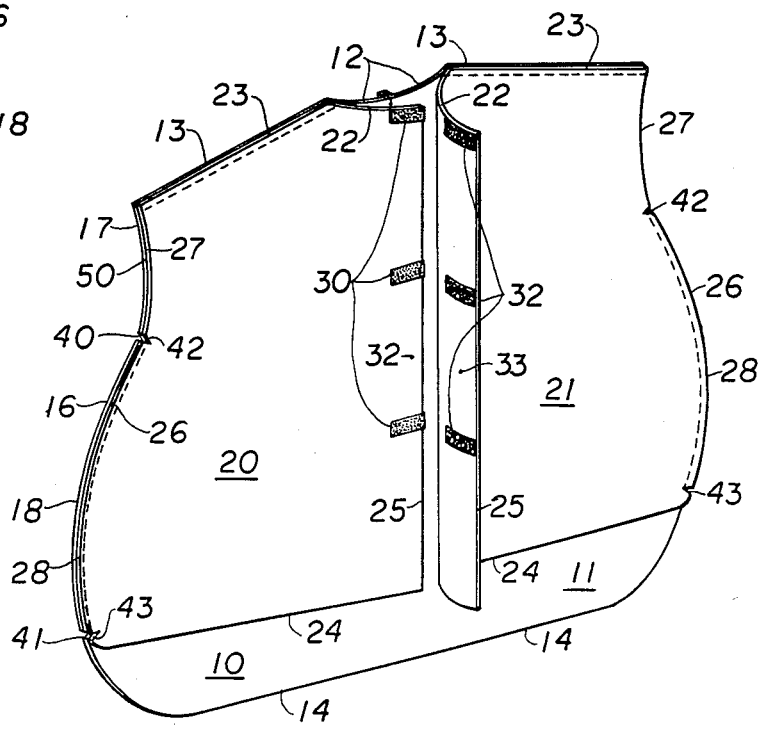
FIG. 3 illustrates the assembly of the front and back panels of a coverlet for non-ambulatory patients embodying the present invention.
Figure 4:
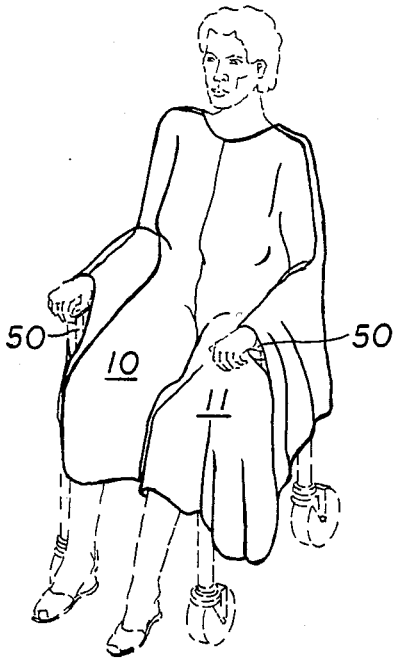
FIG. 4 is a front perspective view in wearing position of a coverlet for non-ambulatory patients embodying the present invention, the broken line outline of a wearer and a shower chair shown for purposes of illustration only.

Assembly of the present invention is accomplished as depicted in FIG. 2 by sewing together seam edges 15 of right and left front panels 10 and 11, and as depicted in FIG. 3 by sewing lower front portion 18 of right front panel 10 between upper front terminus 40 and lower front terminus 41 to lower back portion 28 of right back panel 20 between upper back terminus 42 and lower back terminus 43, and similarly by sewing lower front portion 18 of left front panel 11 between upper front terminus 40 and lower front terminus 41 to lower back portion 28 of left back panel 21 between upper back terminus 42 and lower back terminus 43.

As an alternative embodiment of the present invention, not illustrated, said right and left front panels can be formed from a single piece of goods, so that the assembly of said right and left front panels 10 and 11 by sewing together seam edges 15 is eliminated.

The present invention is placed about patients by placing their arms through armholes 50 formed by upper front portions 17 and upper back portions 27. Thereafter, the present invention is secured about patients with assistance from health care personnel by attaching right back panel 20 and left back panel 21 together by slightly overlapping opening edges 25 and affixing hook side VELCRO strips 30 to eye side VELCRO strips 32, or, in the alternative, by the use of ties, snaps, or hooks attached along opening edges 25 (not shown).

The relative and absolute dimensions of the present invention as set forth hereinabove are chosen in order to fulfill the requirements of four criteria, that is, so that the present invention can easily be placed about and removed from patients of varying physiques, so that patients of varying physiques will be comfortable during transportation, so that patients will at all times be completely covered except for the head, lower forearms and hands, and lower calves and feet, and so that when the present invention is in place about patients in a shower chair or mobile commode, front bottom edges 14 and back bottom edges 24 do not interfere with the movement and operation of the shower chair or mobile commode.

The present invention having been described in its preferred embodiment, it is clear that it is susceptible of numerous modifications and embodiments within the ability of those skilled in the art and without the exercise of the invention faculty. Accordingly, the scope of the present invention is defined by the scope of the following claims.

What is claimed is:

1. Coverlet comprising:

right and left front panels, each having a vertical seam edge, a horizontal front bottom edge disposed perpendicular to, adjacent to and below said seam edge, a curved front neck notch disposed generally opposite to said front bottom edge and adjacent to said seam edge, a sloping front shoulder edge disposed adjacent to said front neck notch and sloping downward toward said front bottom edge and away from said seam edge, and a curvilinear front edge disposed adjacent to said front bottom edge and said front shoulder edge having an arched upper front portion disposed concave with respect to said seam edge and an arched lower front portion disposed convex with respect to said seam edge;

means for attaching said right front panel to said left front panel along said seam edges;

right and left back panels, each having a vertical opening edge, a horizontal back bottom edge disposed perpendicular to, adjacent to and below said opening edge, a curved back neck notch disposed generally opposite to said back bottom edge and adjacent to said opening edge, a sloping back shoulder edge disposed adjacent to said back neck notch and sloping downward toward said back bottom edge and away from said opening edge, and a curvilinear back edge disposed adjacent to said back bottom edge and said back shoulder edge having an arched upper back portion disposed concave with respect to said opening edge and an arched lower back portion disposed convex with respect to said opening edge;

means for attaching said right front panel to said right back panel and said left front panel to said left back panel along said front shoulder edges and said back shoulder edges and along said lower front portion of said curvilinear front edges and said lower back portion of said curvilinear back edges; and means for removably attaching said right back panel to said left back panel along said opening edges.

2. Coverlet as defined in claim 1, wherein said opening edge of said right and left back panels is shorter than said seam edge of said right and left front panels.

3. Coverlet as defined in claim 1, wherein said back bottom edge of said right and left back panels is longer than said front bottom edge of said right and left front panels.

4. Coverlet as defined in claim 1, wherein said means for removably attaching said right back panel to said left back panel along said opening edges comprises:

a plurality of hook side VELCRO strips attached to the exterior surface of and adjacent to said opening edge of said right back panel; and a plurality of eye side VELCRO strips attached to the interior surface of and adjacent to said opening edge of said left back panel at positions corresponding to the positions of said hook side VELCRO strips.

5. Coverlet comprising:

right and left front panels, each having a vertical seam edge, a horizontal front bottom edge disposed perpendicular to, adjacent to and below said seam edge, a curved front neck notch disposed generally opposite to said front bottom edge and adjacent to said seam edge, and sloping front shoulder edge disposed adjacent to said front neck notch and sloping downward toward said front bottom edge and away from said seam edge, and a curvilinear front edge disposed adjacent to said front bottom edge and said front shoulder edge having an arched upper front portion disposed concave with respect to said seam edge and an arched lower front portion disposed convex with respect to said seam edge;

means for attaching said right front panel to said left front panel along said seam edges;

right and left back panels, each having a vertical opening edge shorter than said seam edges of said right and left front panels, a horizontal back bottom edge longer than said front bottom edges of said right and left front panels, disposed perpendicular to, adjacent to and below said opening edge, a curved back neck notch disposed generally opposite to said back bottom edge and adjacent to said opening edge, a sloping back shoulder edge disposed adjacent to said back neck notch and sloping downward toward said back bottom edge and away from said opening edge, and a curvilinear back edge disposed adjacent to said back bottom edge and said back shoulder edge having an arched upper back portion disposed concave with respect to said opening edge and an arched lower back portion disposed convex with respect to said opening edge;

means for attaching said right front panel to said right back panel and said left front panel to said left back panel along said front shoulder edges and said back shoulder edges and along said lower front portion of said curvilinear front edges and said lower back portion of said curvilinear back edges; and means for removably attaching said right back panel to said left back panel along said opening edges.

6. Coverlet as defined in claim 5, wherein said means for removably attaching said right back panel to said left back panel along said opening edges comprises:

a plurality of hook side VELCRO strips attached to the exterior surface of and adjacent to said opening edge of said right back panel; and a plurality of eye side VELCRO strips attached to the interior surface of and adjacent to said opening edge of said left back panel at positions corresponding to the positions of said hook side VELCRO strips.

7. Coverlet comprising:

a front panel having a horizontal front bottom edge, a generally horizontal front top edge having a centered a curved front neck notch disposed generally opposite to said front bottom edge and a pair of mirror-image sloping front shoulder edges disposed bilaterally with respect to said front neck notch and sloping downward toward said front bottom edge, and a pair of mirror-image curvilinear front edges disposed bilaterally with respect to and adjacent to said front bottom edge and adjacent to one of said front shoulder edges, each having an arched upper front portion disposed concave with respect to the interior of said front panel and an arched lower front portion disposed convex with respect to the interior of said front panel;

right and left back panels, each having a vertical opening edge, a horizontal back bottom edge disposed perpendicular to, adjacent to and below said opening edge, a curved back neck notch disposed generally opposite to said back bottom edge and adjacent to said opening edge, a sloping back shoulder edge disposed adjacent to said back neck notch and sloping downward toward said back bottom edge and away from said opening edge, and a curvilinear back edge disposed adjacent to said back bottom edge and said back shoulder edge having an arched upper back portion disposed concave with respect to said opening edge and an arched lower back portion disposed convex with respect to said opening edge;

means for attaching said front panel to said right and left back panels along said front shoulder edges and said back shoulder edges and along said lower front portion of said curvilinear front edge and said lower back portion of said curvilinear back edge; and means for removably attaching said right back panel to said left back panel along said opening edges.

8. Coverlet as defined in claim 7, wherein said opening edge of said right and left back panels is shorter than the distance between the midpoint of said front neck notch and said front bottom edge.

9. Coverlet as defined in claim 8, wherein the sum of the lengths of said back bottom edges of said right and left back panels is greater than the length of said front bottom edge of said front panel.

10. Coverlet as defined in claim 9, wherein said means for removably attaching said right back panel to said left back panel along said opening edges comprises:

a plurality of hook side VELCRO strips attached to the exterior surface of and adjacent to said opening edge of said right back panel; and a plurality of eye side VELCRO strips attached to the interior surface of and adjacent to said opening edge of said left back panel at positions corresponding to the positions of said hook side VELCRO strips.

* * * * *